United States Patent [19]

Rozner

[11] 3,952,552

[45] Apr. 27, 1976

[54] AUXILIARY YARN DYEING MECHANISM

[75] Inventor: Allan Rozner, Fresh Meadows, N.Y.

[73] Assignee: C.J.I. Industries, Inc., New York, N.Y.

[22] Filed: Sept. 29, 1972

[21] Appl. No.: 293,352

[52] U.S. Cl. ..... 66/125 A; 68/19.1; 118/405; 139/36; 28/75 R

[51] Int. Cl.[2] ..... D04B 35/00

[58] Field of Search ..... 66/125 A, 125 R; 68/9, 68/10, 19.1, 19; 139/36; 118/405; 28/75 R; 112/79 R

[56] References Cited

UNITED STATES PATENTS

| | | | |
|---|---|---|---|
| 1,943,818 | 1/1934 | Fantone et al. | 118/405 |
| 2,247,716 | 7/1941 | Schellenberg et al. | 66/125 A |
| 2,310,764 | 2/1943 | Denhof | 66/125 A |
| 2,712,297 | 7/1955 | McGrew | 68/9 |
| 2,797,711 | 7/1957 | Ballard | 139/36 |
| 3,067,600 | 12/1962 | Minton | 66/125 A |
| 3,120,051 | 2/1964 | Spurgeon | 66/125 A |
| 3,197,324 | 7/1965 | Brooks | 118/405 |
| 3,421,926 | 1/1969 | Davies et al. | 28/75 R |
| 3,813,260 | 5/1974 | Lipstein | 118/405 |

FOREIGN PATENTS OR APPLICATIONS

| | | | |
|---|---|---|---|
| 1,804,856 | 8/1969 | Germany | 112/79 R |

*Primary Examiner*—Mervin Stein
*Assistant Examiner*—Andrew M. Falik
*Attorney, Agent, or Firm*—Gottlieb, Rackman, Reisman & Kirsch

[57] ABSTRACT

There is disclosed a mechanism for dyeing yarns as they are fed from their cones into a knitting machine. Each yarn passes through a container in which there is a liquid dye of a color selected for that particular yarn. Although a quick-drying dye is used, to insure that each yarn is completely dried prior to its reaching a respective knitting needle, a jet of air is directed against each yarn as it exits from its respective dye container.

2 Claims, 3 Drawing Figures

FIG.2
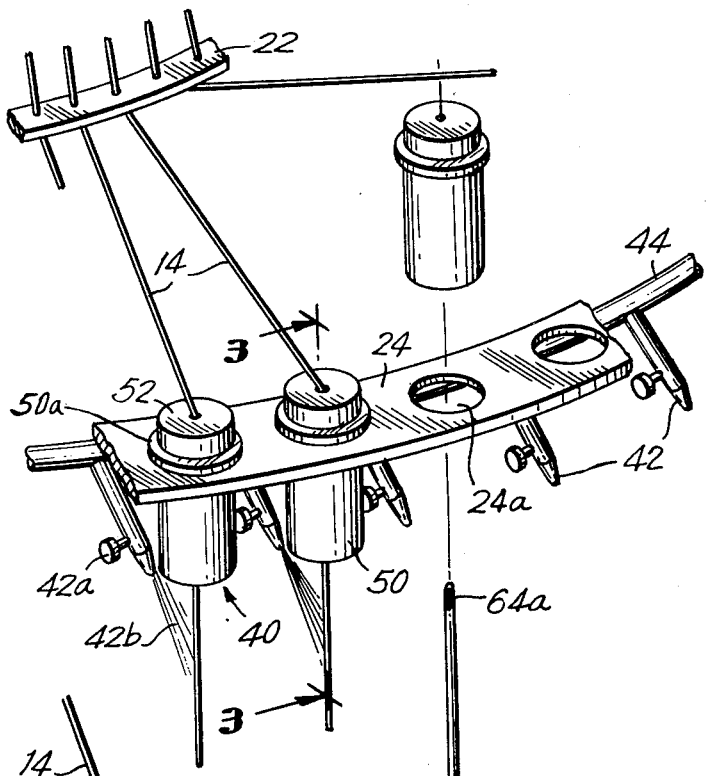
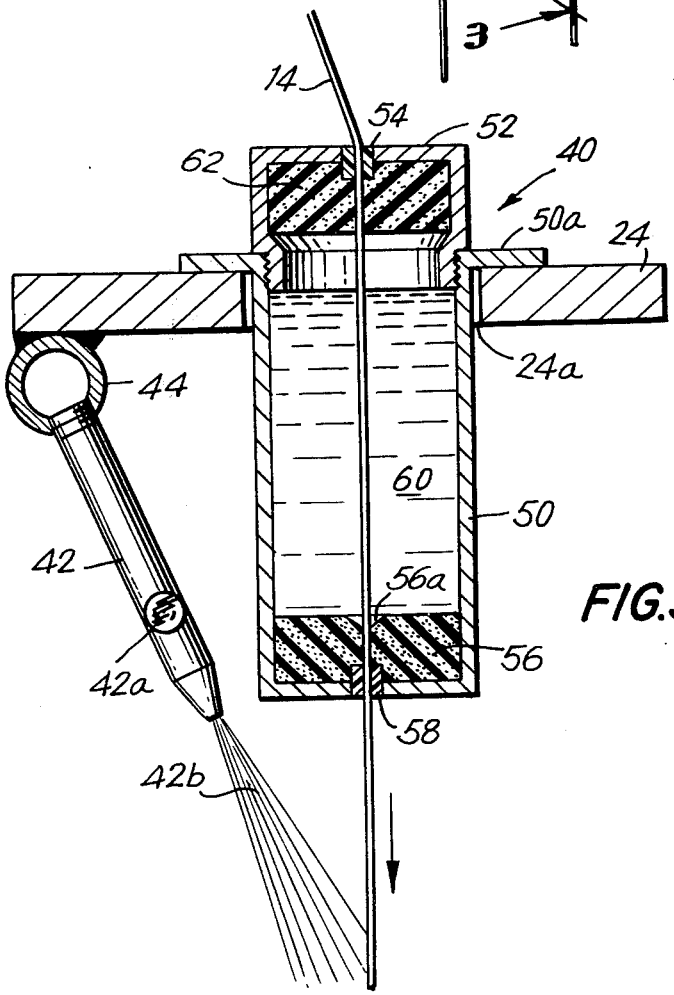
FIG.3

AUXILIARY YARN DYEING MECHANISM

This invention relates to dyeing mechanisms, and more particularly to the use of dyeing mechanisms on knitting and weaving machines.

In recent years, the demand for attractive fabrics and garments has increased substantially. An important aspect of the demand has been the growth in the appeal of colored goods for both men's and women's fashions. This has caused the textile industry to be quite attentive to the problem of preparing colored fabrics.

There are two principal ways of achieving a colored pattern in a knitted or woven fabric. In one, a knitted or woven fabric is dyed or printed after it is made. In the other, the individual yarns are dyed before the fabric is made.

A typical knitting machine has a plurality of yarn cones or packages mounted on or adjacent to it, with the individual yarns being guided to the knitting needles. The conventional way of dyeing yarn before it is actually woven or knitted into a fabric is to "package dye" the yarn cone, by forcing a liquid dye through all of the yarn layers on the cone under high pressure. This technique for dyeing yarn is not wholly reliable, since some portions of the yarn may not receive uniform application of the dye. Another shortcoming of this approach is that the knitter is made highly dependent on the dyer, who is usually at another location. If, on the other hand, the finished fabric is printed, the fabric cannot be completed and delivered to a customer until the additional printing steps are performed. Furthermore, the extra processing (either dyeing or printing) could be avoided in many cases by using pre-dyed yarn to develop patterned goods.

In the case of fabric which is dyed only after the knitting or weaving has been completed, a rather restricted scope of patterns and colors is available for such goods, due to the difficulty of selectively applying dye to different parts of the same piece of goods.

It is a general object of my invention to provide a mechanism which allows a knitter or weaver to dye yarns prior to their incorporation in a fabric, and without requiring an additional processing operation.

It is a further object of my invention to provide the capacity to dye yarn as an integral step in the operation of a knitting or a weaving machine.

Briefly, in accordance with the principles of my invention, I provide a plurality of dye containers, one for each yarn element to be dyed. Each container is filled with a particular color dye to be used for a respective yarn which is fed to the container from the yarn package or cone. All of the containers are mounted on a guide ring at the top of a knitting machine so that the individual yarns pass through their respective dye containers in the vertical direction. As each yarn is pulled off its respective cone, it passes through its dye container and is thereby dyed prior to its reaching a knitting needle. Upon emerging from its dye container, each yarn is dried by causing it to pass through an air stream which is directed at the yarn as it travels between the dye container and its respective knitting needle.

In the illustrated embodiment of my invention, all of the dye containers are mounted in a circular guide ring disposed at the top of the machine. A circular air manifold is disposed underneath the guide ring and individual air nozzles connected to the air manifold direct an air stream at each yarn as it is drawn out of the bottom of its respective dye container. Such an arrangement is particularly suitable for conventional knitting machines, and can be incorporated easily in already existing machines. Furthermore, all that is required to change the color of each yarn is to change the dye in the container through which the yarn passes.

It is therefore a feature of an embodiment of my invention to provide a plurality of dye containers on a fabric forming machine, each containing a dye therein and having a yarn passing therethrough prior to its being incorporated into the fabric being made.

It is another feature of an embodiment of my invention to provide a jet of air for each yarn to dry it as it exits from its respective dye container.

Further objects, features and advantages of my invention will become apparent upon consideration of the following detailed description in conjunction with the drawing, in which:

FIG. 2 depicts in greater detail a section of the guide ring of the machine and associated elements in accordance with the principles of my invention; and FIG. 3 is a sectional view taken along the line 3—3 of FIG. 2 in the direction of the arrows.

Figure 1:
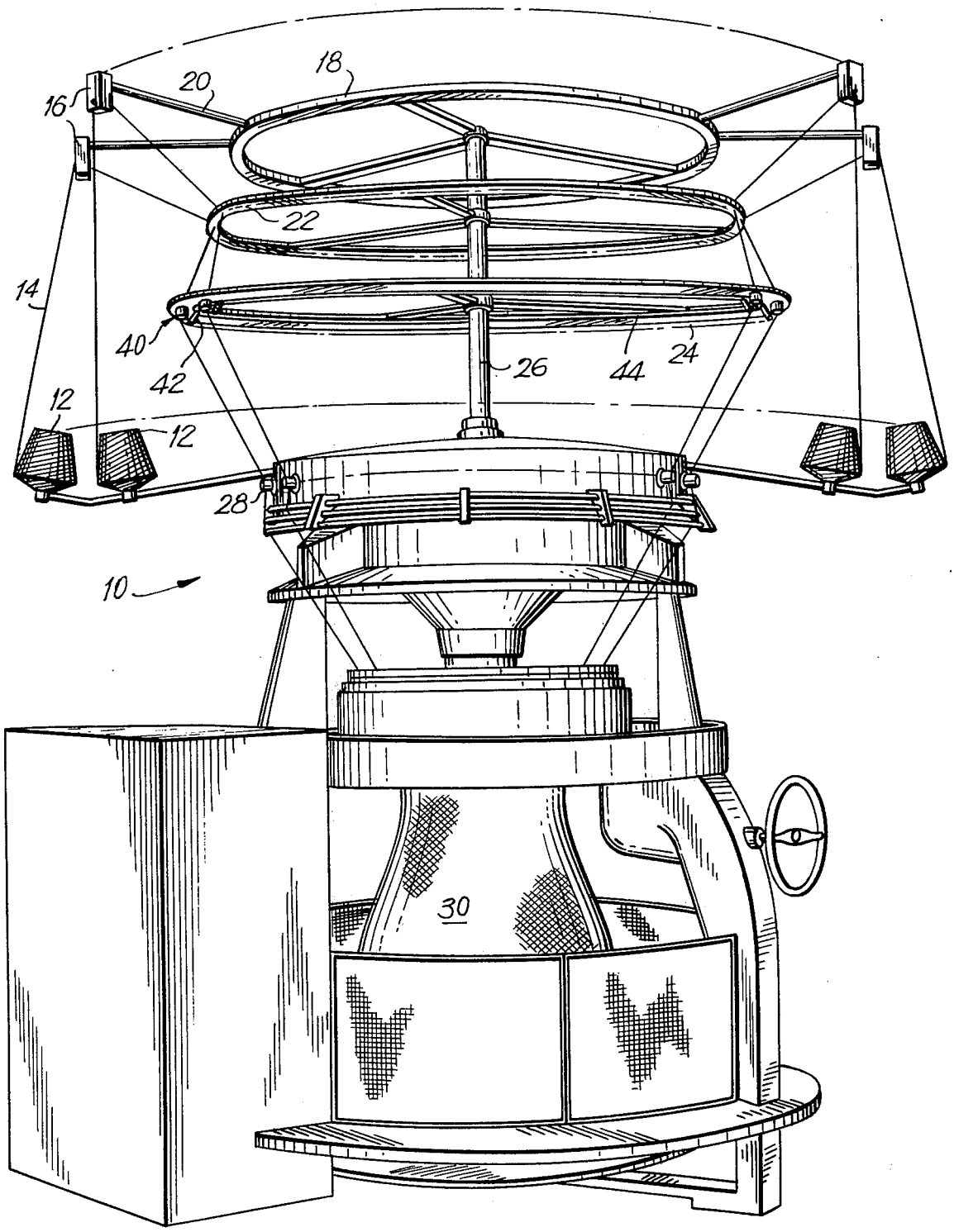
FIG. 1 depicts a prior art type knitting machine incorporating an illustrative embodiment of my invention.

Circular knitting machine 10 of FIG. 1 is of conventional design except for guide ring 24, dye containers 40 which are mounted in the guide ring, air manifold 44 and the nozzles 42 which project from it. A plurality of yarn cones 12 are mounted on respective projecting arms. The yarn 14, which is drawn from each cone, passes through a number of guide elements. Each yarn first passes through a tensioning device 16 which is mounted at the end of an arm 20 which projects from central ring 18. Tensioning device 16 serves to reduce or eliminate tension in the yarn as it passes toward the knitting needles, thus reducing the incidence of yarn tears. Upper support ring 18, as well as guide rings 22 and 24, are all centered on vertical post 26. After passing through a tensioning device 16 each yarn passes through a guide aperture (not shown) in ring 22, and then through one of the containers 40 of my invention which is mounted in guide ring 24. Thereafter, each yarn passes around a standard feed post 28 on the knitting machine, after which it is extended to a respective knitting needle in the fabric forming part of the machine. The finished knitted fabric, in tubular form, is shown by the numeral 30 in FIG. 1.

The added elements of my invention are shown in greater detail in FIG. 2, which illustrates a section of the upper portion of the knitting machine. Here it is seen that each yarn 14, after passing through a guide hole in ring 22, passes through the top of one of dye containers 40 on its way to a knitting needle. The dye containers 40 are mounted in spaced holes **24*a* in guide ring 24, which is supported by central post 26 (FIG. 1). Inside each container 40 is a quantity of quick-drying dye of any conventional type, such as a dye made with Napthol. As each yarn 14** passes through its respective dye container, the natural (uncolored) yarn is dyed.

Although the dye is quick drying, to insure that all of the yarns are dried before they are actually knitted into the fabric being made, an air manifold 44 is mounted on the underside of guide ring 24. Nozzles 42, each having a control valve **42*a* for adjusting the strength of its air spray, are coupled to manifold 44 at locations corresponding to each dye container 40.** A pressure higher than atmospheric pressure is maintained in the air manifold (by a conventional source not shown in the drawing, but generally available in most knitting machines) and a jet of air is thus directed through each nozzle against a respective yarn as it emerges from the bottom of the dye container. This insures that each yarn will be dried by the time that it reaches the respective knitting needle.

In FIG. 3, the constructional details of each of dye containers 40 are shown. The container has a lower cylindrical section 50 with a circular flange 50*a*. The upper part 52 of the container is also generally cylindrical in shape. Suitable mating threads permit the upper and lower sections to be screwed together. Following assembly, the container 40 is placed within a hole 24*a* in the guide ring 24, and is supported therein by its flange 50*a*.

A Teflon insert 54 is provided at the top of section 52 and a similar Teflon insert 58 is provided in the bottom of section 50. At the top of the upper section there is a layer of resilient material 62, such as foam rubber or the like, and a similar layer 56 is provided at the bottom of the container. Liquid dye 60 is contained between the two layers, with the layers 56, 62 serving to promote ease of yarn movement as well as preventing leakage of the dye.

The yarn 14 passes through Teflon insert 54, resilient layer 62, dye 60, resilient layer 56 and Teflon insert 58, and then emerges from the bottom of container 40. The two Teflon inserts provide a smooth narrow passageway for the yarn to enter into the exit from the dye container. The layer 56 permits the yarn 14 to pass through a central hole provided for that purpose, and at the same time prevents leakage of the liquid dye because of its resilient and absorbent nature.

The invention includes the capacity to change dye colors quite readily. In order to change the color of the dye, all that is required is to unscrew the two cylindrical sections 50 and 52 from each other, and to replace the two resilient layers and the dye. Alternatively, the entire container can be replaced, with each container being used for only a particular color dye.

In order to thread a new yarn through a dye container, a needle 64 is provided as shown in FIG. 2. The needle 64 includes an eye 64*a* through which the end of a yarn can be threaded. The needle is then inserted through the dye container from the top to the bottom. As the needle is pulled through the container, the free end of the yarn is pulled with it. Resilient layer 56 is provided with a conical cut-out 56*a* (as shown in FIG. 3) to guide the forward end of the needle 64 down toward Teflon insert 58, thereby facilitating the passing of the free end of a new yarn through the container. Needle 64 is sufficiently long so as to project out of bottom hole 58 while its upper portion having eye 64*a* projects out of top hole 54 of container 40; this facilitates threading of yarn 14 through any given container 40.

As shown in FIG. 3, air nozzle 42 is disposed underneath guide ring 24. One end of the nozzle is coupled to air manifold 44, and the lower end of the nozzle directs a spray of air 42*b* against yarn 14 for the purpose of drying it. The air flow can be controlled by a conventional valve 42*a*.

Although the invention has been described with reference to a particular embodiment, it is to be understood that such embodiment is merely illustrative of the application of the principles of the invention. For example, instead of providing for the passage of only one yarn through each dye container, it is possible to provide several pairs of Teflon inserts so as to guide several yarns, which must be dyed the same color, through the same dye container. Thus it is to be understood that numerous modifications may be made in the illustrative embodiment of the invention and other arrangements may be devised without departing from the spirit and scope of the invention.

What I claim is:

1. In a fabric forming machine having a plurality of means each for supplying a yarn to be used in forming a fabric, operating means for incorporating the yarn into a fabric, and means for guiding the yarn toward said operating means, the improvement comprising a plurality of containers each having a dye therein and a yarn passageway therethrough, each of said yarns which is to be dyed being passed through one of said containers in its path of travel between the respective supplying means and operating means, and further including means for directing a spray of air against each of said yarns as they exit from said containers for ensuring the drying of the yarn prior to its reaching said operating means.

2. In a fabric forming machine having a plurality of means each for supplying a yarn to be used in forming a fabric, operating means for incorporating the yarn into a fabric, and means for guiding the yarn toward said operating means, the improvement comprising a plurality of containers each having a dye therein and a yarn passageway therethrough, each of said yarns which is to be dyed being passed through one of said containers in its path of travel between the respective supplying means and operating means, wherein the yarn passing through each of said containers exits from the container through a hole at one end thereof, and each of said containers includes at least one layer of resilient absorbent material having a channel therethrough and disposed at said one end thereof for guiding a yarn toward said hole in said container, and including a needle for threading said yarn through said container, said needle being of sufficient length for one end thereof to protrude from said hole at said one end of said container while the other end of said needle carrying said yarn protrudes from the other end of said container.

* * * * *